United States Patent [19]

Bondoc

[11] 4,373,992

[45] Feb. 15, 1983

[54] NON-ASBESTOS FLOORING FELT CONTAINING PARTICULATE INORGANIC FILLER, A MIXTURE OF FIBERS AND A BINDER

[75] Inventor: Alfredo A. Bondoc, Middlesex, N.J.

[73] Assignee: Tarkett AB, Ronneby, Sweden

[21] Appl. No.: 249,322

[22] Filed: Mar. 31, 1981

[51] Int. Cl.[3] ..... D04H 1/64; D21F 11/00; D21H 5/12; D21H 5/18

[52] U.S. Cl. ..... 162/145; 162/146; 162/168.4; 162/169; 162/181.1; 162/181.4; 162/181.6; 162/181.8; 162/183; 428/44; 428/281

[58] Field of Search ..... 428/281, 44; 162/145, 162/146, 168.4, 169, 183, 181.1, 181.4, 181.6, 181.8

[56] References Cited

U.S. PATENT DOCUMENTS

| | | | |
|---|---|---|---|
| 2,138,456 | 11/1938 | MacNutt | 428/281 |
| 2,802,765 | 8/1957 | Baymiller et al. | 428/281 |
| 3,248,257 | 4/1966 | Cadotte et al. | 428/281 |
| 4,225,383 | 9/1980 | McReynolds | 162/146 |
| 4,245,689 | 1/1981 | Grard et al. | 162/146 |
| 4,293,612 | 10/1981 | Andersson et al. | 428/281 |

*Primary Examiner*—James C. Cannon
*Attorney, Agent, or Firm*—Littlepage & Webner

[57] ABSTRACT

Flooring felt containing glass fibers, cellulosic fibers, synthetic fibers, particulate inorganic filler, latex binder and calcium hydroxide.

15 Claims, No Drawings

NON-ASBESTOS FLOORING FELT CONTAINING PARTICULATE INORGANIC FILLER, A MIXTURE OF FIBERS AND A BINDER

BACKGROUND OF THE INVENTION

Decorative sheet-type covering material such as a sheet vinyl floor or wall covering is frequently made with a substrate comprising sheet-type felt material. The felt generally used for this purpose comprises, as a major component, cellulosic fibers and/or asbestos fibers. Synthetic fibers are sometimes used but are quite expensive. When accessive amounts of synthetic fibers are used, the felt frequently cannot maintain the required dimensional stability and strength characteristics at the elevated temperatures generally used in the manufacture of sheet vinyl flooring. The use of asbestos fibers in such felt is considered to represent a health hazard, while the use of large amounts of cellulosic fibers results in felt which tends to have poor dimensional stability and which is unduly susceptible to biological degradation, especially when installed on or below grade.

SUMMARY OF THE INVENTION

It is an object of the invention to provide improved sheet type felt, an improved process for preparing sheet type felt and sheet type covering material using such felt.

Sheet type felt of the invention comprises on a dry basis;

(a) between about 1 and about 10 weight percent (wt %) glass fibers;
(b) between about 3 and about 25 wt % cellulosic fibers;
(c) between about 3 and about 20 wt % synthetic organic fibers;
(d) between about 3 and about 70 wt % particulate inorganic filler;
(e) between about 10 and about 30 wt % latex binder;
(f) between about 3 and about 80 wt % calcium hydroxide; and
(g) between about 0.1 and about 10 pounds polymeric flocculating agent per ton of felt.

The process of the invention is a process for preparing sheet type felt which comprises:

(a) providing an aqueous dispersion of fibers, particulate inorganic filler and calcium hydroxide;
(b) adding to said dispersion between about 10 and about 30 wt % on a dry basis of latex binder to thereby uniformly distribute product of precipitation of the latex binder and calcium hydroxide onto particles of filler and onto fibers;
(c) then adding polymeric flocculant to flocculate fibers and filler; and
(d) then removing water to form felt.

Sheet covering material of the invention is otherwise conventional sheet type covering material having a substrate comprising the sheet type felt of the invention.

DETAILED DESCRIPTION OF THE INVENTION

Glass fibers present in felt of the invention preferably have fiber lengths between about 1 and about 12 mm and diameters between 3 and about 20 microns. Glass fibers less than 3 microns in diameter should be avoided because of the health hazards believed to be inherent in the use and handling of such fibers. Felt of the invention is therefore preferably free of glass fibers less than 3 microns in diameter. Conventionally surface treated chopped glass fibers having nominal fiber lengths within the range of from about 1 to about 6 mm are preferred.

Cellulosic fibers for use in the invention include all of the cellulosic fibers commonly used in the manufacture of felt and paper, including for instance fibers derived from wood, cotton, waste paper, etc.

Synthetic organic fibers suitable for use in the invention are preferably between about 0.5 and about 6 millimeters (mm) in length and preferably between about 1 and about 15 denier. Fibers of such diverse materials as polyester, polypropylene, polyethylene, nylon, etc., are for instance suitable with polyester fibers and fibrillated polyolefin fibers being preferred. Fibrillated polypropylene fibers are especially preferred.

Particulate inorganic filler suitable for use in the invention includes a wide variety of conventional fillers previously known for use in various types of felt, paper and plastics. Filler used in the felt of the invention should generally have an average particle size of about 1 to 30 microns to facilitate the manufacture of felt with the desired physical characteristics via a conventional wet laid process on conventional papermaking machines. The filler should generally have a maximum particle size of about 100 microns in order to ensure a relatively smooth felt when made in conventional thicknesses.

Particulate inorganic filler for use in the invention should be at least partially insoluble in water. Substantially water insoluble fine or fine ground mineral materials such as silica flour, calcium carbonate, Portland cement, fly ash, ground mica, slate flour, clay, stone dust, diatomaceous earth, fullers earth, talc, and/or other synthetic and natural fine mineral filler materials may for instance be used. Clay, especially kaolin clay is a particularly preferred material for the filler. As mentioned below, calcium hydroxide may also be used as a filler in practicing the invention.

It is especially preferred that felt of the invention be essentially free of asbestos.

Any of the wide variety of natural and artificial latexes generally known for use in felt manufacture may be used. Conventional styrene-butadiene rubber (SBR) latex is preferred with carboxylated SBR latex being especially preferred. Other suitable latexes include for instance, natural rubber, vinyl acetates, vinyl chlorides, acrylic or neoprene latexes, etc. Mixtures of such latexes may also be used. Anionic latexes are preferred.

Calcium hydroxide for use in the invention is present in particulate form, preferably in the particle sizes mentioned above with respect to particulate filler material. Hydrated lime is a preferred form of calcium hydroxide. Hydrated lime may, if desired, be formed in situ by reaction of lime and water. At least a portion of the calcium hydroxide and latex binder present in felt of the invention is present in the form of precipitation product of calcium hydroxide and latex uniformly distributed onto particles of filler and onto fibrous components of the felt. Calcium hydroxide is used in the invention primarily as a coagulant to form the above mentioned precipitation product of calcium hydroxide and latex. When used only for this purpose the calcium hydroxide is preferably present in felt of the invention in amounts between about 3 and about 15 weight percent on a dry basis. It is also, however, within the scope of the invention to utilize additional amounts of calcium hydroxide beyond the amount which can precipitate with the latex. In this case the additional calcium hydroxide functions as a filler as well as a coagulant and the amount used may range up to about 80 weight percent of the felt on a dry basis.

The incorporation of calcium hydroxide in felt of the invention serves several important functions. In addition to coagulating or precipitating the latex the calcium hydroxide eliminates the odor frequently associated with common types of latex containing mercaptan chain transfer agents and which is not alleviated by the use of more conventional precipitating material such as alum. In addition the calcium hydroxide helps to prevent biological growth in the felt and in sheet covering materials using the felt as substrate. Also, and perhaps most importantly, it has been found that the use of calcium hydroxide unexpectedly increases the tensile strength of the felt. Good tensile strength is especially important when the felt is used as substrate for sheet type covering material such as vinyl floor or wall covering. The greater the tensile strength, the less likely the felt is to break during use for this or other purposes.

Polymeric flocculating agents suitable for use in the invention are water dispersible or water-soluble, ionic or nonionic polymers. Organic polymers such as polyethylenimine and various polyacrylamides such as carboxyl-containing polyacrylamides, copolymers of acrylamide with dimethylaminoethyl methacrylate or diallyldimethyl ammonium chloride are, for instance, suitable Polyacrylamides are preferred as flocculants for the invention. The exact nature of the flocculating agent used is not critical to the invention.

In a preferred embodiment at least about 5 weight percent and more preferably between about 5 and about 40 weight percent on a dry basis of processed mineral fiber of short fiber length, may be included in felt of the invention to improve dimensional stability. PMF fibers from Jim Walters Resources, Inc. are suitable. Such materials enhance felt formation and surface smoothness as well as contributing to runnability on a paper machine and improving dimensional stability of the finished felt. While processed mineral fibers of longer length may be used, preferred mineral fibers have diameters between about 1 and about 10 microns and aspect ratios between about 40 to 1 and 60 to 1 .

In other respects the composition of felt of the invention is a balanced composition of ingredients forming a felt produce possessing excellent strength properties, smooth surface characteristics, dimensional stability, resistance to microbiological growth and paper machine runnability. Furthermore, the felt of the invention is useable and processable into sheet vinyl flooring in a conventional manner. Of the various fibers used in felt of the invention, the synthetic fibers contribute to runnability on paper machines, the cellulose fibers in general contribute to runnability and to hot tensile and room temperature tensile strength and the glass fibers give dimensional stability. In order to achieve maximum dimensional stability, it is preferred that the ratio of glass fibers to cellulose fibers be between about 0.1 and about 2 to one preferably between about 0.5 and about 1 to one.

In making felt of the invention it is preferred that the latex be added to the previously formed aqueous dispersion of fibers, filler and calcium hydroxide rather than being precipitated with the calcium hydroxide prior to mixing with the dispersion of fibers and filler. When latex binder is added to a previously formed aqueous dispersion of fiber, filler and calcium hydroxide in accordance with the invention the calcium hydroxide and latex precipitate to uniformly distribute on substantial portions of the surfaces of filler particles and the surfaces of cellulosic and synthetic fibers the precipitation product of the calcium hydroxide and latex. Significant amounts of such precipitation product also are normally present in the aqueous phase of the resulting dispersion. By contrast if calcium hydroxide is precipitated with latex prior to mixing with an aqueous dispersion of fibers and filler, the precipitation product would be expected to be in the form of lump-like or chain-like coagulant which would not be expected to subsequently distribute uniformly onto surfaces of particles of filler or fiber.

While the mechanism by which the use of calcium hydroxide unexpectedly improves tensile strength of felt of the invention is not completely understood, it is believed that it may be related to the degree of solubility of calcium hydroxide in water. Calcium hydroxide is substantially less soluble in water than more conventional precipitating agents such as alum. The partially soluble calcium hydroxide generates substantial numbers of cations that interact with the latex in the dispersion system to cause precipitation in such a manner that uniform distribution of product of precipitation is obtained and an optimum degree and quality of crosslinking is attained.

The use of polymeric flocculating agents is necessary to obtain proper felt formation and solids retention on the paper machine forming wire. The point of addition of flocculant to the paper machine stock should be such that it is well mixed with the slurry and the floc formed are broken small enough for good formation and large enough for good retention. The polymeric flocculant's function is to form agglomerates and to tie up the nonfibrous constituents to themselves and to the fibrous ingredients in the slurry, prior to felt formation. The flocculation mechanism can be attributed to either the ionic charge interaction and/or the high molecular weight long chain bridging of the polymeric material.

In accordance with the process of the invention the polymeric flocculating agent is added to the dispersion after addition of the latex and after the dispersion has been completely formed. The flocculating agent causes flocculation of fibers and fillers in a conventional manner and is preferably introduced to the dispersion shortly before water is removed from the dispersion such as on a conventional paper making machine.

In practicing the invention it is preferred that the aqueous dispersion used have a consistency on the order of about 8–10 percent. It has been found that use of this consistency rather than the more conventional consistency of 5–6 percent reduces the tendency of glass fibers to agglomerate and form "fuzz balls" of glass filaments. The use of conventional glass fiber dispersant, including certain types of surfactants and polymers, could be relied upon for this purpose, but useage of such materials breeds more complex interaction problems in subsequent steps of the felt making process.

In forming sheet type covering material from felt of the invention conventional layers of material such as foamed or unfoamed layers of polyvinyl chloride, decorative and wear layers, etc., may be used. In general felt of the invention is suitable as a substrate for any conventional sheet type covering material such as sheet vinyl floor or wall covering.

EXAMPLE I

Various felt samples having the compositions (on a dry basis) shown in Table I were made and tested for tensile strength. In each case the felt was made by first forming an aqueous dispersion of fibers, clay and either hydrated lime or alum, depending upon which of these two ingredients was used for each sample. In each case the dispersion was first formed in a blender and then transferred to a beaker. Latex was then added to the dispersion with sufficient agitation to thoroughly distribute and precipitate the latex in the dispersion. Following precipitation of the latex, the flocculant was added, thereby flocculating fibers and particulates. Finally, the dispersion was placed on a screen to drain the water therefrom and form a hand sheet which was then pressed, dried and tested for tensile strength. The hand sheets had a basis weight of about 80 lbs. per 500 sq. ft. and a density of about 50 lbs. per cubic ft. Room temperature tensile strength was determined with an Instron tester on 1 inch by 6 inch samples pulled at a rate of 2 inches per minute crosshead speed with jaws initially 4 inches apart. Hot tensile strength was determined with a Scott tester on 1 inch by 6 inch samples heated to 350° F. for 30 seconds and pulled at a rate of 12 inches per minute with jaws initially 4 inches apart. The tensile strength reported in Table I was in each case the average of two determinations.

TABLE I

| Ingredient | Amount (Grams Dry Basis) Sample No. 1 | 2 | 3 | 4 | 5 | 6 | 7 | 8 |
|---|---|---|---|---|---|---|---|---|
| Sulfite Wood Pulp | 1.8 | 1.8 | 0.7 | 0.7 | 0.4 | 0.4 | 1.1 | 1.1 |
| Fibrillated Polypropylene (Hercules Pulpex P-AD) | 5.4 | 5.4 | 5.4 | 5.4 | 5.4 | 5.4 | 5.4 | 5.4 |
| Glass Fibers - ⅛" | 1.8 | 1.8 | 1.8 | 1.8 | 1.8 | 1.8 | 1.8 | 1.8 |
| SBR Latex (GAF 5080) | 5.4 | 5.4 | 5.8 | 5.8 | 5.8 | 5.8 | 6.1 | 6.1 |
| Hydrated Lime | | 1.8 | | 1.8 | | 3.6 | | 1.8 |
| Kaolin Clay | 21.6 | 19.8 | 22.3 | 20.5 | 22.7 | 19.1 | 20.5 | 19.8 |
| Polyacrylamide Flocculant (Betz 1260-ml of 0.5% aqueous solution) | 2 | 2 | 2 | 2 | 2 | 2 | 2 | 2 |
| Alum (ml of 1% aqueous solution) | 125 | | 125 | | 125 | | 125 | |
| Tensile Strength (lb/in) (room temperature) | 48 | 73 | 48 | 63 | 48 | 59 | 52 | 68 |
| Tensile Strength (lb/in) (350° F.) | 20 | 27 | 20 | 26 | 16 | 27 | 17 | 26 |

It can be seen from Table I that each of the felt samples made with hydrated lime had significantly higher room temperature tensile strength and hot tensile strength than the corresponding felt using alum.

EXAMPLE II

To further confirm that the use of calcium hydroxide rather than other coagulants to precipitate latex results in felt having improved tensile strength, several additional felts containing the ingredients shown in Table II were made and tested as described in Table I. The polyacrylamide flocculant was as in Example I Betz 1260 and was used in the form of a 0.5% aqueous solution.

TABLE II

| Ingredient | Amount (Grams Dry Basis) Sample No. 9 | 10 | 11 | 12 |
|---|---|---|---|---|
| Sulfite Wood Pulp | 3.6 | 3.6 | 3.6 | 3.6 |
| Fibrillated polypropylene (Hercules Pulpex P-AD) | 3.6 | 3.6 | 3.6 | 3.6 |
| Glass Fibers - ⅛" | 0.7 | 0.7 | 0.7 | 0.7 |

TABLE II-continued

| Ingredient | Amount (Grams Dry Basis) Sample No. 9 | 10 | 11 | 12 |
|---|---|---|---|---|
| Processed Mineral Fibers (Jim Walters Corp. PMF) | 2.2 | 2.2 | 2.2 | 2.2 |
| SBR Latex (GAF 400-76E) | 5.4 | 5.4 | 5.4 | 5.4 |
| Hydrated Lime | 2.5 | — | — | — |
| Kaolin Clay | 18.0 | 20.5 | 20.5 | 20.5 |
| Polyacrylamide Flocculant (Betz 1260-ml of 0.5% aqueous solution) | 2 | 2 | 2 | 2 |
| Aluminum Chloride (ml of 1% aqueous solution) | — | — | 60 | — |
| Epoxy Resin (Hercules Inc Kymene 2064 5% aqueous solution NaOH activated) | — | 10 | — | — |
| Calcium Chloride (1% aqueous solution) | — | — | — | 150 |
| Room Temperature Tensile Strength (lb/in) | 85 | 50 | 62 | 61 |
| Hot Tensile Strength (lb/in) | 30 | 18 | 20 | 18 |

While the invention has been described with respect to preferred embodiments thereof, it will be understood by those skilled in the art that various changes and modifications may be made without departing from the spirit and scope of the invention.

I claim:

1. Sheet type felt comprising on a dry basis;

(a) between about 1 and about 10 wt. % glass fibers;
(b) between about 3 and about 25 wt % cellulosic fibers;
(c) between about 3 and about 20 wt % synthetic organic fibers;
(d) between about 3 and about 70 wt % particulate inorganic filler;
(e) between about 10 and about 30 wt % latex binder;
(f) between about 3 and about 80 wt % calcium hydroxide; and
(g) between about 0.1 and about 10 pounds polymeric flocculating agent per ton of felt.

2. Felt according to claim 1 wherein at least a portion of the latex and calcium hydroxide is present in the form of precipitation product uniformly distributed onto particles of filler and onto fibers.

3. Felt according to claim 1 which is essentially free of asbestos.

4. Felt according to claim 2 wherein the synthetic fiber comprises polyolefin.

5. Felt according to claim 4 wherein the polyolefin is fibrillated polyproylene.

6. Felt according to claim 1 wherein the glass fibers have average diameters in excess of about 3 microns and fiber lengths between about 0.5 and about 6 mm.

7. Felt according to claim 1 wherein the filler has an average particle size less than about 30 microns.

8. Felt according to claim 7 wherein the filler comprises kaolin clay.

9. Felt according to claim 1 wherein the filler comprises calcium hydroxide.

10. Felt according to claim 1 wherein the flocculant is polyacrylamide.

11. Felt according to claim 1 wherein the latex binder comprises anionic synthetic rubber.

12. Felt according to claim 1 wherein the latex comprises carboxylated styrene-butadiene rubber.

13. Felt according to claim 1 wherein:

a. the synthetic fiber comprises fibrillated polyolefin;

b. the glass fibers have average diameters in excess of 3 microns and fiber lengths between about 0.5 and about 6 mm;

c. the filler has an average particle size less than about 30 microns;

d. the latex binder comprises anionic synthetic rubber; and e. the flocculating agent comprises polyacrylamide.

14. Felt according to claim 1 which also includes at least about 5 weight percent on a dry basis of process mineral fiber.

15. Felt according to claim 14 wherein the mineral fiber has diameter between about 1 and about 10 micron and aspect ratios between about 40 to 1 and about 60 to 1.

* * * * *